US005574106A

United States Patent [19]

Allen

[11] Patent Number: 5,574,106

[45] Date of Patent: Nov. 12, 1996

[54] ACRYLIC POLYMERS AND THEIR USE IN STAIN RESISTANT POLYAMIDE TEXTILE PRODUCTS

[75] Inventor: Adrian S. Allen, North Yorkshire, England

[73] Assignee: Allied Colloids Limited, England

[21] Appl. No.: 373,881

[22] Filed: Jan. 17, 1995

Related U.S. Application Data

[63] Continuation of Ser. No. 693,562, Apr. 30, 1991, abandoned.

[30] Foreign Application Priority Data

May 1, 1990 [GB] United Kingdom ..... 9000723

[51] Int. Cl.[6] ..... C08L 77/00; D06M 15/693

[52] U.S. Cl. ..... 525/183; 8/446; 8/455; 428/96; 428/267

[58] Field of Search ..... 525/183; 428/96, 428/267; 8/446, 455

[56] References Cited

FOREIGN PATENT DOCUMENTS

| | | | |
|---|---|---|---|
| 0215565 | 3/1987 | European Pat. Off. . | |
| 216479 | 4/1987 | European Pat. Off. . | |
| 0333500 | 9/1989 | European Pat. Off. . | |
| 0342919 | 11/1989 | European Pat. Off. . | |
| 1183086 | 3/1970 | United Kingdom | 525/183 |

*Primary Examiner*—Ana L. Carrillo
*Attorney, Agent, or Firm*—Ostrolenk, Faber, Gerb & Soffen LLP

[57] ABSTRACT

Addition polymers suitable for imparting stain resistance to nylon carpets and other polyamide products are formed of styrene or other ethylenically unsaturated monomer containing cyclic hydrocarbon groups, sodium vinyl sulphonate or other ethylenically unsaturated strong acid monomer, and ethylenically unsaturated weak acid monomer that is preferably acrylic acid. The proportions of the monomer are, respectively, 7 to 50%, 1 to 20% and 40 to 90% by weight.

5 Claims, 4 Drawing Sheets

ACRYLIC POLYMERS AND THEIR USE IN STAIN RESISTANT POLYAMIDE TEXTILE PRODUCTS

This is a Continuation of application Ser. No. 07/693,562 filed on Apr. 30, 1991 now abandoned.

Polyamide products, including nylon fibres, can be dyed with acid dyes that are substantive to the dyeable dye sites of the polyamide structure, generally as a result of reaction between the acid dye and basic amino sites in the polyamide molecular structure.

When the dye has been applied to the fabric, it is important that it does not migrate to undyed areas and it is common to treat the dyed product with materials to block the undyed sites in order to prevent dying of these by any dye that may migrate from the dyed areas.

A particularly well known group of compounds which are used for blocking the undyed sites are known as Syntans and these are sulphonated phenol formaldehyde condensation products.

A particular problem that arises with carpets and other textiles of nylon and other polyamide fibres is that they are liable to staining by accidental application of domestic stains such as fruit juice and coffee. One way of restricting such staining is by applying a water repellent coating to the fibres, but this affects detrimentally the handle of the fibres and wears off during use.

Another way is by impregnating the carpet with a material similar to the Syntans. In particular in U.S. Pat. No. 4,592,940 the nylon carpet is impregnated with particular sulphonated polymeric condensation products of formaldehyde with one or more particular sulphonated phenols. Although this treatment does improve resistance to staining by acid stains, such as fruit juices, it is not entirely satisfactory. One problem is that although carpets treated in this manner are more stain resistant if sufficient of the sulphonated condensation product is added, the amount is such that they are prone to yellowing when exposed to sunlight or any strong light rich in ultraviolet, and so such carpets tend to yellow during use, especially in areas exposed to sunlight. Another problem is that the treatment does not give satisfactory resistance to all types of stains that may be encountered. Thus the resistance to stains due to tea and coffee can be inadequate and, in particular, the resistance to stains due to turmeric (such as mustard) is very poor.

U.S. Pat. No. 4,822,373 (Olson) discloses treatment of a polyamide substrate to prevent staining with a composition including both a partially sulphonated novolak resin and a polymethacrylic acid or copolymer of methacrylic acid. The sulphonated novolak resins are exemplified by condensation products of for example, formaldehyde with bis (hydroxy phenol) sulphone and phenol sulphonic acid. The methacrylic acid copolymer can comprise copolymers with one or more monomer besides methacrylic acid and a wide range of ethylenically unsaturated monomers are suitable including carboxylic acids, anhydride esters and amides and vinyl monomers. This composition can also have the same yellowing problems as the previous condensation polymer substances due to the presence of methylene bridges between the phenol groups.

In EP-A-329899, the yellowing problems of sulphonated phenol-formaldehyde condensation products are discussed and the application reviews various known methods of overcoming problems of yellowing, including acylating or etherifying some of the phenolic hydroxyls of the sulphonated condensation product. The application discloses a non-sulphonated material for treating polyamide textiles and which is a hydrolysed ethylenically unsaturated aromatic-maleic anhydride polymer. However these products are problematic because they are not sufficiently soluble and do not form sufficiently stable dispersions in acidic application liquors and consequently variable application and inferior performance can result.

In EP-A-333500, is taught improved stain-resist properties and improved non-yellowing tendencies by treating polyamide products with an addition polymer of one or more vinyl addition monomer comprising 10 to 80 mole % monomer containing sulphonic acid groups and 10 to 80 mole % monomer containing at least one aromatic or cycloaliphatic or heterocyclic group. It is said that this must be applied to the polyamide product by permeating through the molecular structure of the product when the product is swollen by heat and/or moisture. The best results can only be obtained using dicyclopentadiene polymers, which are commercially inconvenient to make. When using simpler polymers (Example 3), worse results were obtained.

Unfortunately none of these processes give as good a combination of stain resistance and non-yellowing as would be desired when using simple polymers. In the present invention the applicants have found a novel class of polymers that can be used to give greatly improved stain resistance properties and that can be simple to make from readily available monomers.

An addition polymer according to the invention is soluble or dispersible in aqueous acid and is formed from (a) ethylenically unsaturated monomer that contains cyclic hydrocarbon groups and that is free of acidic groups, (b) ethylenically unsaturated, strong acid monomer and (c) ethylenically unsaturated, weak acid monomer, and is characterised in that the relative weight percentages of these types of monomer are as shown in Table 1 and/or are as defined by ABCDE of the ternary diagram of FIG. 1. The precise quantitative meaning of these lines is defined below.

The weak acid preferably comprises or consists of acrylic acid.

The polymers according to the present invention have good properties of both substantivity to polyamide compounds and good stain resist properties and are substantially colourless in use.

The invention also includes a polyamide product that has undyed dyeable sites and in which substantially all the undyed dyeable dye sites are blocked by a substantially non-colouring polymer that is chemically substantive to the said undyed sites, that is soluble or dispersible in aqueous acid and that is an addition polymer as defined above.

The ethylenically unsaturated monomers can be allyl but are generally vinyl and at least some of them are often acrylic. Any cyclic monomers are preferably monocyclic.

Throughout this specification all percentages are by weight. In monomer (a) the cyclic group may be distant from the ethylenic group through which copolymerisation occurs, being connected to the group by for instance, a polyethoxy chain. The monomer is then an associative monomer, for instance as described in EP 172025, 172723 or 216479 and the prior art discussed in those. Preferably the cyclic group has the ring either integral with the backbone of the polymer or pendant from the backbone by a linkage of zero, 1 or 2 atoms. For instance cyclopentadiene provides an aliphatic ring integral with the backbone, styrene provides an aromatic ring connected to the backbone through a linkage containing zero carbon atoms, vinyl ethers would provide a linkage of 1 atom and acrylic monomers would provide a linkage of two atoms. The cyclic group may be an aromatic, cycloaliphatic or heterocyclic group. Naturally it is preferred that the cyclic group does not include a condensation product that includes a methylene bridge, and should not form one during polymerisation or use, as these structures are prone to chromophore formation and yellowing on exposure to sunlight. The monomer must be free of carboxylic acid groups and strong acid groups.

Suitable examples of cyclic hydrocarbon containing monomers are styrene and substituted styrenes such as p-acetoxystyrene, chlorostyrene, methoxystyrene, and alpha-methylstyrene, vinyl toluene, cyclohexyl acrylate, isobornyl methacrylate, N-cyclohexyl acrylamide, N-benzyl acrylamide, N-4 methyl phenyl methyl acrylamide, N-diphenyl methyl acrylamide and N,N-diphenyl methacrylamide, benzyl (meth) acrylate, stilbene, di-cyclopentadiene, methyl styryl ketone and vinyl benzyl ether. The monomer can include phenolic groups such as allyl phenol, vinyl phenol and 4-styryl phenol. The preferred cyclic hydrocarbon containing monomers are styrene and acetoxy styrene.

In monomer (b) the strong acid group must be sufficiently strong that the polymer is soluble or easily dispersible in aqueous acid and the strong acid group may help make the polymer substantive to the basic amino sites. It may be sulphonic, sulphate or phosphate.

For example suitable strong acid containing monomers are sodium styrene sulphonate, acrylamido methyl propane-sulphonic acid, sodium (meth) allyl sulphonate, sodium dicyclopentadiene sulphonate, sodium vinyl toluene sulphonate, sodium sulphoethyl (meth) acrylate, sodium sulphopropyl (meth) acrylate, sodium (meth) acryloxyethyl phosphate, N,N-dimethyl N-methacryloxyethyl-N-(3-sulphopropyl)ammonium-betain, N,N-Dimethyl-N-methacrylamidopropyl-N-(3-sulphopropyl)ammonium-betain and 1-(3-sulphopropyl)-2-vinyl pyridimum-betain. Preferred are sodium styrene sulphonate, sodium acryamido methyl propane sulphonate and sodium di-cyclopentadiene sulphonate.

The preferred strong acid containing monomer units have a pKa below 2 and most preferably below 1. The strong acid is often introduced in the form of an alkali metal salt.

The weak acid containing monomers contain acid groups that are weaker acids than the strong acid monomers described above and can also be substantive to the amino groups of polyamide. The weak acid groups are normally carboxylic groups.

For example, suitable weak acid containing monomer units are acrylic acid, methacrylic acid, maleic acid, fumaric acid, itaconic acid, crotonic acid, cinnamic acid, hydroxyacrylic acid and alkyl, aryl, alkylaryl or cycloaliphatic half esters of maleic, fumaric and itaconic acid. Preferably the weak acid monomer does not include a cyclic hydrocarbon group. Preferred weak acids are maleic acid and especially acrylic acid.

The pKa value of the weak acid units is preferably from 3 to 11 and most preferably from 4 to 10. The weak acid is preferably introduced in free acid form.

It is particularly preferred for the weak acid to comprise a carboxylic monomer in which the α carbon atom (the carbon to which the carboxylic group is attached) is an unsubstituted carbon, thus acrylic acid is strongly preferred relative to methacrylic acid. The α carbon can carry a substituent such as methyl or carboxylic but it is strongly preferred for the β carbon to be wholly unsubstituted and so acrylic acid is the preferred weak acid monomer. The combination of the preferred monomers (especially acrylic acid) with the other monomers (especially the cyclic monomer) appears to lead to a particularly desirable steric arrangement of the groups within the polymer and this promotes its effectiveness as a stain resist for polyamides. It is probable that the improved results are due to the distribution of monomer groups within the polymer chains and that the use of acrylic acid gives a more favourable distribution (from the point of view of stain resist properties) than methacrylic acid.

Generally at least 50%, preferably at least 75%, and most preferably all the weak acid monomer is acrylic acid.

The combination of strong and weak acid groups and their proportions must be such that the polymer is substantive to polyamide dyeable sites, soluble or dispersible in aqueous acid, and has a surface energy such that the polymer will coat onto (or impregnate into) the polyamide surface structure.

Generally monomers (a), (b) and (c) comprise 100% of the monomer content of the polymer but there can be a relatively small amount of other monomer present in the polymer. For example the polymer can comprise 70 to 99% monomers (a), (b) and (c) and 1 to 30% of other monomers. Other monomer units which can be present can be non acidic hydrophilic monomer units, such as acrylamide, dimethyl acrylamide, methacrylamide, N-methylolacrylamide, N-isobutoxymethyl acrylamide, N-vinyl acetamide, N-vinyl formamide, N-vinyl pyrrolidine, vinylalcohol, hydroxyethyl (meth) acrylate, hydroxyproply (meth) acrylate, (meth) acrylic monoesters and allyl monethers of polyethylene oxide, polypropylene oxide, methoxy-polyethyleneoxides and alkyl or alkylaryl alkoxylates and/or non cyclic hydrophobic monomers such as acrylonitriles, alkyl-(meth) acrylates and-crotonates having from 1 to 20 carbon atoms in the alkyl chain, dialkyl allyl ether or vinyl esters wherein the alkyl chain has from 1 to 20 carbon atoms, or ethylene or higher olefins.

BRIEF DESCRIPTION OF THE FIGURES

The accompanying drawings are ternary diagrams showing the polymers according to the invention in terms of weight percentages of the different types of monomers.

It is preferred that the weight percentages of the monomers are defined by JKLMN and most preferably PQRST.

The weight percentages of these three types of monomer in the polymers of the invention are defined more precisely in Table 1.

TABLE 1

| | Composition Range | | |
|---|---|---|---|
| Monomer Class | General | Preferred | Most Preferred |
| Cyclic hydrocarbon (a) | 7–50 | 15–35 | 20–32 |
| Strong acid (b) | 1–20 | 2–15 | 3–12 |
| Weak acid (c) | 40–90 | 50–80 | 57–72 |

Figure 1:
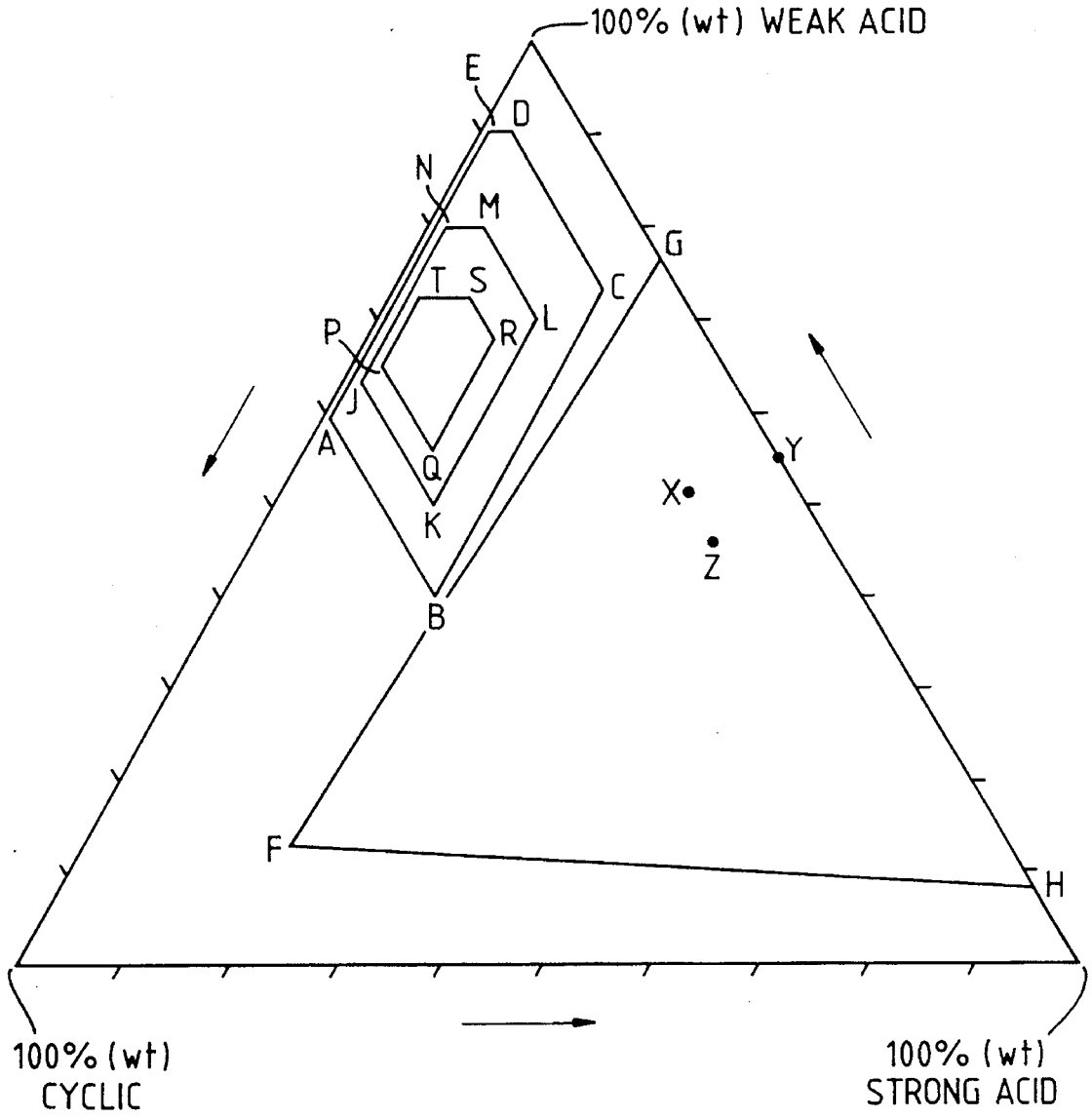
FIG. 1 shows polymers of the invention outlined by ABCDE. In this the maximum amount of strong acid is shown as 40% and this is preferred, but useful results can be obtained at up to 50% strong acid. The preferred polymers are defined by JKLMN and the most preferred polymers by PQRST. In addition, FGH illustrates the disclosure of EP 333500.

FIG. 1 also illustrates the disclosure of the closest prior art, EP 333500 which is defined by FGH and points X, Y and Z indicate the polymers exemplified in examples 1, 2 and 3 respectively, of EP 333500. It can be seen therefore that the disclosure of the closest prior art is to a very wide range of polymers with all the examples being directed to compositions very different from the very narrow range defined in the invention, and having around 40 to 50% by weight of strong acid containing monomer and very low amounts of cyclic group containing monomers.

The results are based on polymer compositions in which the cyclic containing monomer is styrene, the weak acid containing monomer is acrylic acid and the strong acid containing monomer is sodium styrene sulphonate and so the results may vary slightly with different monomer combinations. The diagrams are explained in more detail below.

The polymer is made by addition polymerisation of the required monomer blend. The polymerisation can be conducted by any convenient method such as precipitation, solution, emulsion or dispersion polymerisation, but generally the addition polymerisation is conducted by solution polymerisation in a suitable solvent using free radical initiation. Preferred solvents are those which dissolve both the monomer mixture and the polymer such as alcohols having from 1 to 8 carbon atoms, ketones and esters, dimethyl formamide and dimethyl sulphoxide and mixtures of these together or with water, but any suitable solvent or mixture can be used. The solvent is preferably miscible with aqueous acid if the polymer is subsequently to be used in a solution in aqueous acid.

The number average molecular weight (Mn) is generally above at least 1000, preferably at least 2000 and generally no greater than 100,000, preferably no greater than 25,000. The polydispersity of the polymer (Mw/Mn) of 1.1 to 15.0, preferably 2.0 to 6.0. The method of measurement of these values is by Gel Permeation chromatography using samples of 100 μl at a concentration of 0.15% active on a chromatography column TSK PWXL (G6000+G4000+G3000+guard column). The eluant used is pH 8.0 phosphate buffer with a flow rate of 0.5 ml/min and using a differential refractive index detector on range 4. The calibration is carried out with polystyrene sulphonate and polyacrylic acid molecular weight standards.

The novel polymers may be used as, for instance, dye-fixing agents for acidic dyes on polyamide, dispersants for organic and inorganic pigments, scale inhibitors for boiler water or oil well applications but are particularly suitable for use in the stain resist treatment of polyamides.

The use of these addition polymers when applied to a polyamide product gives good stain-resistance properties with little or no risk of yellowing on exposure to sunlight.

The product to which the polymer is applied can be a synthetic polyamide film but is preferably a fibrous product. It can be in the form of filaments, yarn or staple fibres but is preferably in the form of a textile, most preferably a carpet. The polyamide is usually synthetic, such as nylon 6 or nylon 66, but can be natural such as wool. The textile has normally been done by one or more acid dyes either as a pale monocolour, more usually, as a pattern.

The invention is of particular value during the dyeing of the textile as a replacement for conventional Syntan treatment so as to block undyed sites and prevent staining in unwanted areas by unfixed dye. It is also of particular value when rendering carpets and other textile stain resistant to accidental staining.

Typical addition levels of polymer to polyamide are at least 0.2% by weight and preferably at least 0.4% by weight, and generally no greater than 3.0% by weight and preferably no greater than 1.0% by weight based on the weight of the polyamide.

It is particularly preferred to apply the defined polymer of the invention with a sulphonated phenolic condensation products, such as any of those discussed in U.S. Pat. No. 4,822,373, 4,839,212 and 4,592,940. The weight ratio of the polymer of the invention to the sulphonated or other phenolic condensate is usually in the range 20:1 to 2:1, preferably 10:1 to 3:1. These combinations are particularly advantageous as they provide excellent stain resistance, they combine the physical properties of both components and so are more resistant to a range of conditions than either component alone, and can utilise an amount of phenolic condensate that there is low risk of yellowing problems. The application of the two components is generally effected simultaneously, preferably using a blend of the components, but it can be effected sequentially.

The polymer is applied to a polyamide product from an aqueous acid solution or stable dispersion. Typically the pH of the application liquor is at least 1.0 and may be up to 5.0 but is preferably from 2.0 to 2.5. The pH may be adjusted with any convenient acid. Alternatively it is possible to obtain satisfactory results when as explained above, the polymerisation process has been carried out by addition polymerisation in suitable solvent and that solvent is still present. The solvents which are suitable preferably dissolve both the monomer mixture and the polymer. If necessary, additional solvent may be added to the application liquor to stablise the polymer against precipitation. Typical solvents are C1 to C6 alcohols, ketones and esters, ethylene glycol, propylene glycol, (oligo) ethylene or (oligo) propylene glycol ethers.

Other optional additives to the product or the application liquor and which may be present in the application bath are anionic surfactants and/or salts to increase the substantivity of the polymer onto the polyamide groups of the carpet or other product.

Typical anionic surfactants are sulphates; mono- and di-substituted sulphosuccinates and sulphosuccinamates; mono- an di-substituted phosphates prepared from $C_6$–$C_{22}$ alcohols; alkoxylated $C_4$–$C_{16}$ mono- and di-alkyl phenols, ortho-phenyl phenol, di-styryl phenol and naphthol; alkyl, alkylaryl and aryl sulphonates including sulphonates of toluene, xylene or cumene; naphthalene sulphonic acid formaldehyde condensates and sodium lignosulphonates. The surfactants may be metal, ammonium or amine salts in addition to free acids. Preferred surfactants are sodium salts of sulphated nonyl phenol ethoxylates with 2–10 moles of ethylene oxide and sodium salts of sulphated $C_{12}$–$C_{15}$ alkyl ethoxylates with 2–10 moles of ethylene oxide.

Useful addition levels of anionic surfactant and/or solvent are up to 50% by weight based on the weight of active polymer, more usually 5 to 20% by weight.

Typical salts which can be put into the application liquor to increase the substantivity of the polymer are sodium sulphate, calcium chloride, magnesium sulphate (epsom salts), sodium acetate, aluminium sulphate (alum) and zinc sulphate, with epsom salts being preferred. Typical useful application levels of salts are up to to 5% by weight in the application liquor.

The liquor is generally applied to the polyamide product at temperatures from 40° to 100° C. but preferably is applied at temperatures from 65° to 80° C.

The following are examples of the invention.

EXAMPLE 1

A copolymer of 60 parts acrylic acid, 30 parts styrene and 10 parts sodium styrene sulphonate was made by solution polymerisation as follows. It had a number average molecular weight in the range 4,000 to 5,000.

68.25 g of 99% ethanol, 21.75 g of water and 0.10 g of a 40% solution of the penta sodium salt of diethylene triamine penta acetic acid were stirred in a 700 ml flask fitted with a reflux condenser. The flask was heated in a water bath to reflux. A solution of 2.64 g of ammonium persulphate in 15 ml of water was added.

A solution containing 15.0 g of the sodium salt of styrene sulphonic acid, 48.2 ml of water, 112.5 g of an 80% w/w solution of acrylic acid in water, 159.25 g of 99% ethanol and 45.0 g of styrene was fed into the flask at a continuous linear rate over 3 hours and a solution of 3.36 g of ammonium persulphate in 20.0 ml of water was also fed in over 3½ hours at a steady rate. The solution in the flask was maintained at reflux during the feeds and for 1 hour afterwards. It was then cooled and a solution of 34.75 g of sodium hydroxide pellets dissolved in 150 g of water was addedd slowly and carefully. The ethanol and some water were removed by vacuum distillation. Water was added to the flask to make the net weight 430 g.

The product was a clear, slightly viscous solution.

A series of corresponding polymers were formed from other monomer blends and had the compositions shown in Table 2 below.

EXAMPLE 2

The various polymers were applied at an application level of 0.8% by weight based on the weight of a Nylon 6 cut pile carpet from a 15:1 liquor ratio for 15 minutes 70° C. The pH of the liquor was adjusted to 2.0 with sulphonic acid. The carpet samples were hydroextracted and dried at 60° C. A carpet sample was then saturated with a solution containing 0.08 gm/liter of C.I. food red 17 (F.D. C red 40) and 0.4 gm/liter of citric acid and left to stand at 20° C. for 24 hours. The carpet was then rinsed under cold running water, hydroextracted and dried at 60° C. Staining was then assesed on a modified version of the S.D.C. Grey scale.

Table 2 shows examples of stain resist effectiveness using polymers 1 to 23 as stain resist products. Polymers 1 to 21 were prepared in accordance with the present invention. Polymer 22 is a comparative example containing no strong acid monomer and polymer 23 is a comparative example containing no cyclic hydrocarbon monomer.

The results show that all of the polymers according to the present invention give numbers on the modified Grey scale which are from 7.5 to 9 and comparative polymers 22 and 23 both gave no stain protection with a reading of 2 on the modified Grey scale. When polymer 18 was applied along with epsom salt at 4% in the application liquor, the stain assessment was 8 on the modified Grey scale. Likewise, when polymer numbers 4 and 5 were applied along with 5% by weight of polymer of a sodium salt of sulphated 4 mole ethoxylate of no nonyl phenol and 2% magnesium sulphate in the application liquor, the modified Grey scale staining assessment was increased to 8.

All the polymer treated carpet samples were tested for light induced yellowing, by exposing to light for 40 hours in a Microscal Light Fastners Tester equipped with a mercury-tungsten lamp. None of the carpet samples according to the invention showed any yellowing.

A comparative carpet sample treated with 0.8% by weight of conventional phenolic condensation product type stain blocker prepared from 4,4-dihydroxy diphenol sulphone, phenolsulphonic acid, formaldehyde and sodium hydroxide in molar ratios of 1.3: 1.0: 2.2: 2.0; applied under the same conditions of pH 2.0 and at 70° C. showed good stain resistance of 9 on the modified Grey scale but yellowed badly when exposed to light for 40 hours in the Microscal Test.

TABLE 2

| | Polymer Number | | | | | | | | | | |
|---|---|---|---|---|---|---|---|---|---|---|---|
| | 1 | 2 | 3 | 4 | 5 | 6 | 7 | 8 | 9 | 10 | 11 |
| | Monomers unit in Polymer | | | | | | | | | | |
| Acrylic Acid | 55 | 60 | 65 | 67.5 | | 27.5 | | | | 60 | 60 |
| Sodium Acrylate | | | | | 73 | 36 | 16 | | | | |
| Magnesium Acrylate | | | | | | | 58 | | | | |
| Methacrylic Acid | | | | | | | | 60 | | | |
| Sodium Methacrylate | | | | | | | | | 70 | | |
| Maleic Acid | | | | | | | | | | | |
| Sodium Maleate | | | | | | | | | | | |
| Styrene | 30 | 30 | 30 | 30 | 25 | 27.5 | 22 | 30 | 17 | 15 | |
| p-Acetoxystyrene | | | | | | | | | | 15 | 30 |
| p-Vinyl Phenol | | | | | | | | | | | |
| n-Butyl acrylate | | | | | | | | | | | |
| Sodium Styrene Sulphonate | 15 | 10 | 5 | 2.5 | 2 | 9 | 4 | 10 | 13 | 10 | 10 |
| Sodium Vinyl Sulphonate | | | | | | | | | | | |
| Sodium Allyl Sulphonate | | | | | | | | | | | |
| Sodium AMPS | | | | | | | | | | | |
| Staining Assessment Modified Grey Scale | 8 | 9 | 9 | 7.5 | 7.5 | 9 | 9 | 7.5 | 7.5 | 9 | 9 |

TABLE 2-continued

| | Polymer Number | | | | | | | | | | | |
|---|---|---|---|---|---|---|---|---|---|---|---|---|
| | 12 | 13 | 14 | 15 | 16 | 17 | 18 | 19 | 20 | 21 | 22 | 23 |
| | Monomers units in Polymer | | | | | | | | | | | |
| Acrylic Acid | 40 | | | 60 | 30 | | 65 | 50 | 60 | 60 | 70 | 65 |
| Sodium Acrylate | | 70 | 50 | | | 36 | | | | | | |
| Magnesium Acrylate | | | | | | | | | | | | |
| Methacrylic Acid | | | | | | | | | | | | |
| Sodium Methacrylate | | | | | | | | | | | | |
| Maleic Acid | | | | | 30 | | | | | | | |
| Sodium Maleate | | | | | | 9 | | | | | | |
| Styrene | | | | 15 | 30 | 40 | 20 | 30 | 30 | 30 | 30 | |
| p-Acetoxystyrene | 50 | | | | | | | | | | | |
| p-Vinyl Phenol | | 20 | 40 | | | | | | | | | |
| n-Butyl acrylate | | | | 15 | | | | | | | | 20 |
| Sodium Styrene Sulphonate | 10 | 10 | 10 | 10 | 10 | | | | | | | |
| Sodium Vinyl Sulphonate | | | | | | | | | 10 | | | |
| Sodium Allyl Sulphonate | | | | | | | | | | 10 | | |
| Sodium AMPS | | | | | | 15 | 15 | 20 | | | | 15 |
| Staining Assessment Modified Grey Scale | 9 | 9 | 9 | 8 | 8 | 8 | 7.5 | 8 | 8 | 7.5 | 2 | 2 |

EXAMPLE 3

A range of copolymers were made from styrene, acrylic acid and sodium styrene sulphonate in varying proportions and were subjected to staining tests as in Example 2. The results are illustrated in the ternary diagrams of FIGS. 2 to 4, which show the results when tested for performance as stain resist treatments for nylon 6 carpet. The axes of the ternary diagrams show the different monomer concentrations of the copolymers, and the number given is a measure of the degree of staining.

Staining values are frequently measured on the Grey Scale in which they are expressed as numbers from 1 to 5 where 1 relates to a very dark stain and 5 relates to very slight or no stain. However the results shown on FIGS. 2 to 4 and in table 2 below for staining values are modified Grey Scale numbers and the two correlate as shown in Table 3.

TABLE 3

| Grey Scale | Modified Grey Scale | |
|---|---|---|
| 1 | 2 | Bad staining |
| ½ | 3 | |
| 2 | 4 | |
| ⅔ | 5 | |
| 3 | 6 | |
| ¾ | 7 | |
| 4 | 8 | |
| 4-4/5 | 8.5 | |
| 4/5 | 9 | |
| 4/5-5 | 9.5 | |
| 5 | 10 | No stain |

Figure 2:
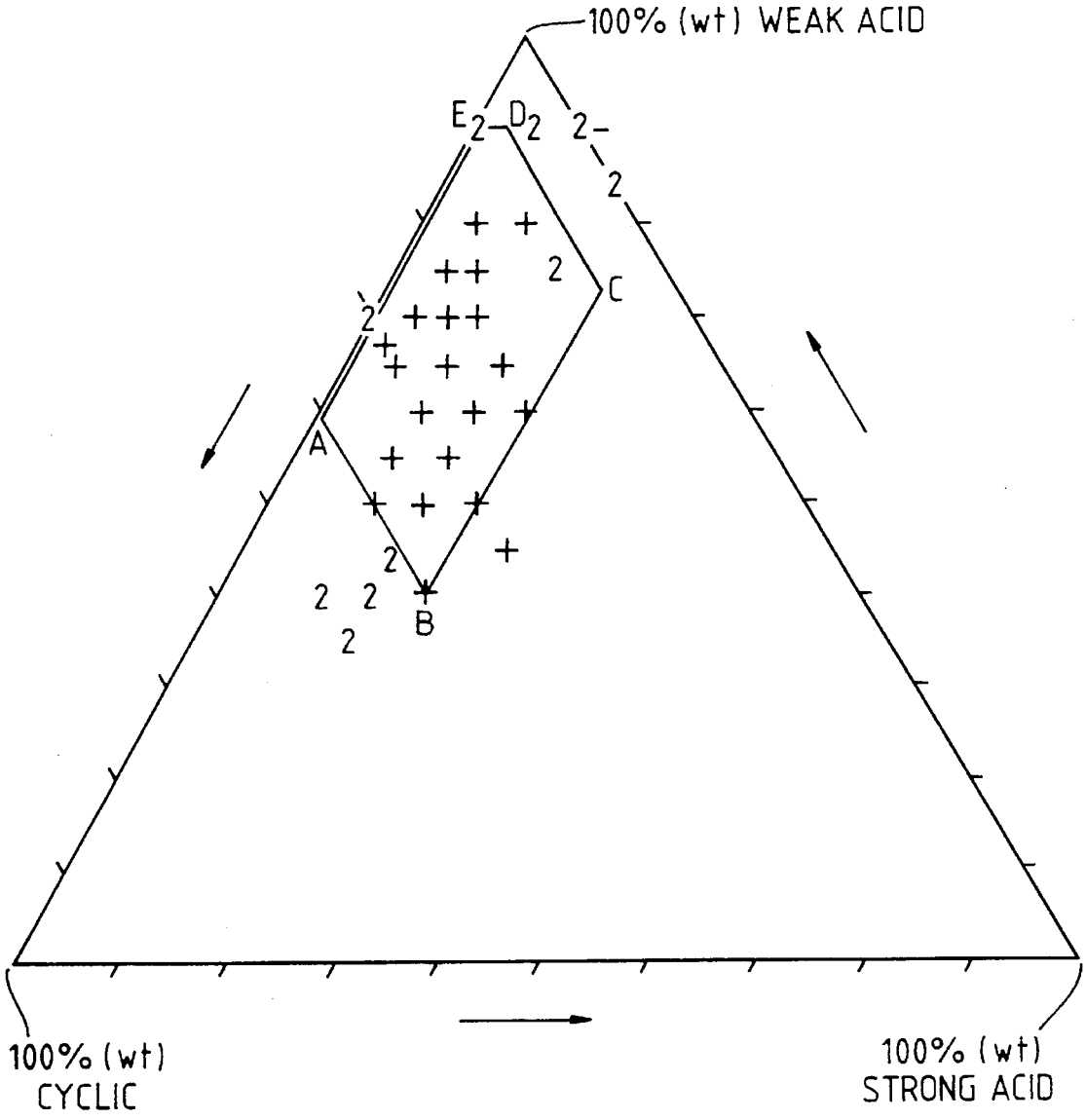
FIG. 2 shows the polymers of the invention and demonstrates comparative results.

FIG. 2 illustrates the polymers of ABCDE claimed in the invention and shows all values from 3 to 9 as + and all poorer results are numbered.

Figure 3:
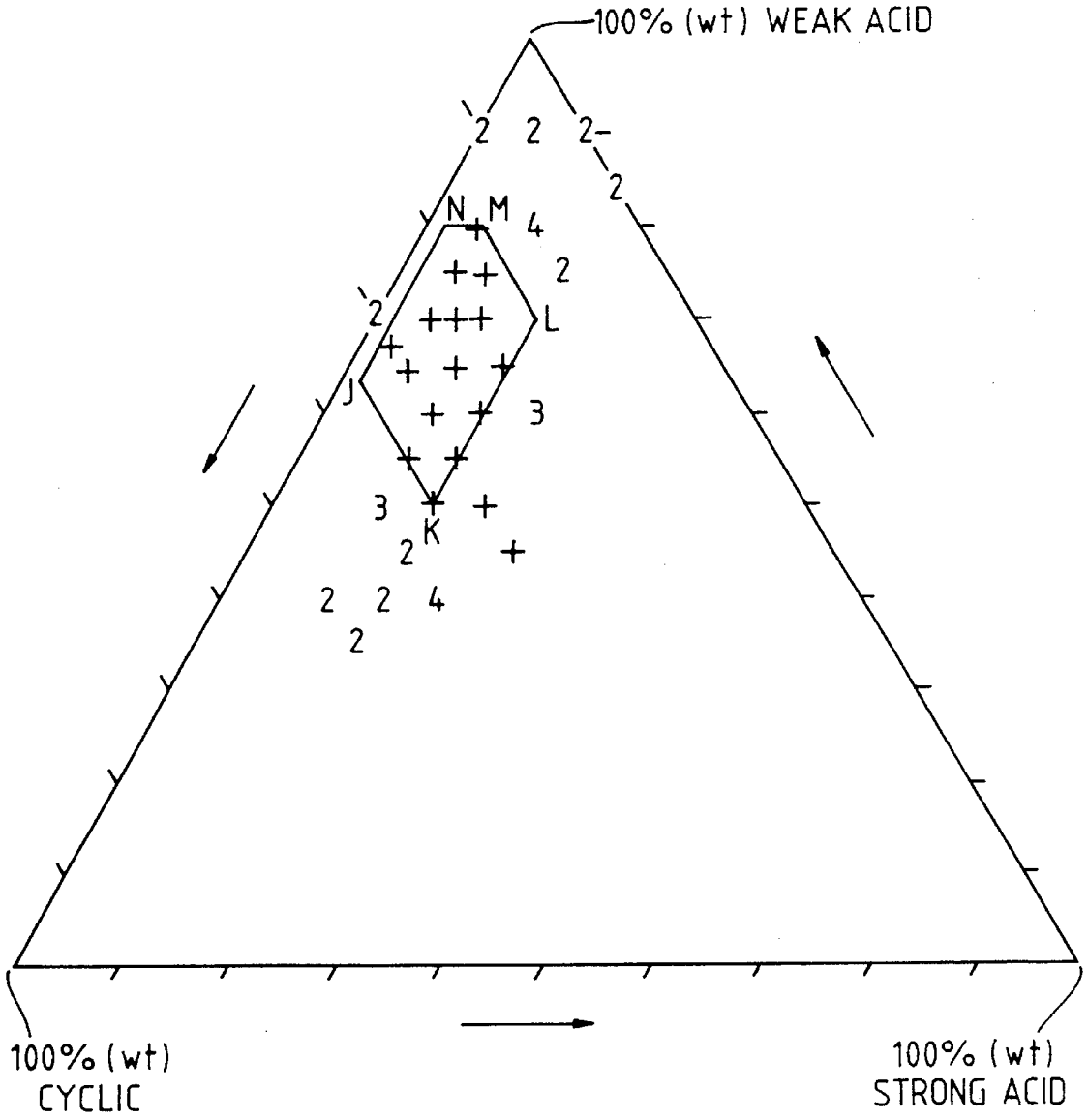
FIG. 3 shows preferred polymers and comparative results and FIG. 4 shows the most preferred polymers and comparative results.

FIG. 3 illustrates the polymers JKLMN and only those polymers giving good results of 5 or above are shown as +.

Figure 4:
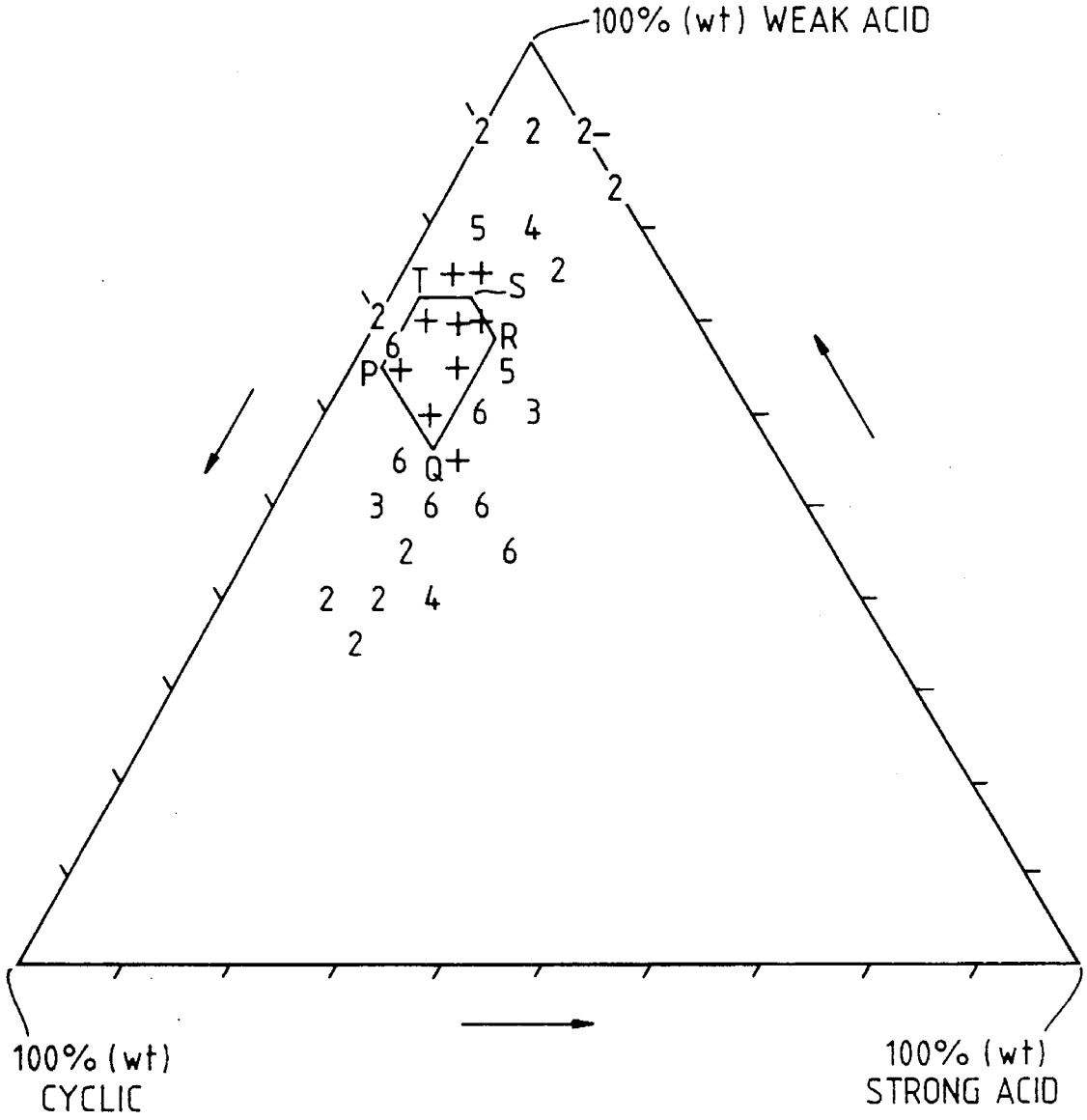

FIG. 4 shows the polymers PQRST and very good stain resist values of 7 and above are indicated as +. These diagrams illustrate the surprisingly good stain resist properties of the small range of copolymers within the very narrow definition of the invention, in contrast to the properties of polymers close to but outside this very narrow definition and in contrast to the copolymers exemplified in EP-A-333500. The modified Grey Scale values for examples 1, 2 and 3 of EP 333500 illustrated on FIG. 1 as X, Y and Z respectively are 7, 6 and 2 but X and Y rely on large amounts of dicyclopentadiene monomer. Z, according to example 3 of EP 333500 is the only real comparative polymer and this has a very low performance giving a modified Grey Scale value of 2.

The results in Table 2, and especially the comparison between polymers 2 and 8, demonstrates the superiority of polymers containing acrylic acid compared to polymers containing methacrylic acid.

EXAMPLE 4

The copolymers were applied to Nylon 6,6 cut pile carpet by the same method given in the other examples. Staining was evaluated as before using the modified Grey Scale.

All the copolymers had a number average molecular weight in the range 5000–6000. To illustrate the effect further examples are also given of blends of the polymers with a phenolic type stainblocker being a condensate of 4–4[1] Dihydroxydiphenyl sulphone, phenol sulphuric acid and formaldehyde. Such blends are often used commercially to achieve an acceptable level of stainblocking without undue light induced yellowing. Phenolic condensates alone generally give a pronounced yellow when applied alone and exposed to light.

| Polymer or Blend | Staining Assessment |
|---|---|
| Copolymer (1) of 60 parts acrylic acid, 30 parts styrene and 10 parts sodium styrene sulphonate | 9.5 |
| Copolymer (2) of 60 parts Methacrylic acid, 30 parts styrene and 10 parts sodium styrene sulphonate | 7 |
| Polymethacrylic acid | 7.5 |
| Copolymer (3) of 85 parts methacrylic acid and 15 parts n-butyl acrylate | 7 |
| Leucotan 970 (a commercial methacrylic acid copolymer) | 6.5 |
| FX 661 (a commercial blend of a | 8.5 |

-continued

| Polymer or Blend | Staining Assessment |
|---|---|
| methacrylic acid copolymer and a phenolic resin produced by 3M) | |
| Blend of 85 parts copolymer 1 with 15 parts phenolic condensate | 10 |
| Blend of 85 parts copolymer 2 with 15 parts phenolic condensate | 8.5 |
| Blend of 85 parts copolymer 3 with 15 parts phenolic condensate | 8.5 |

It was noted that all the copolymers gave no light induced yellowing while blends with phenolic gave some yellowing on exposure to light.

It can be seen that copolymers of the invention containing acrylic acid are superior to those containing methacrylic acid. This superiority is also seen in blends of copolymers with phenolic condensates. The acrylic acid based copolymers and blends with phenolic condensates are also superior to commercial blends containing methacrylic acid.

I claim:

1. A polyamide product that has undyed dyeable dye sites and in which all the undyed dyeable dye sites are blocked by a non-coloring polymeric composition that is soluble or dispersible in aqueous acid and that comprises an addition polymer that is formed from (a) styrene, substituted styrene or phenolic monomer, (b) ethylenically unsaturated strong acid monomer having a pKa below 2 and (c) ethylenically unsaturated weak acid monomer having a pKa of 3–11, characterized in that the weight percentages of the monomers are on or within PQRST of the ternary diagram of FIG. 1 and are 20 to 32% by weight monomer a, 3 to 12% by weight monomer b and 57 to 72% by weight monomer c and which addition polymer has Mn=1000 to 100000.

2. A product according to claim 1 in which Mn=2000 to 25000.

3. A product according to claim 1 in which the weak acid c is acrylic acid.

4. A product according to claim 1 in which monomer b is a sulphonate monomer.

5. A product according to claim 1 wherein the addition polymer is a copolymer of acrylic acid, styrene and sodium styrene sulphonate.

* * * * *